US007907098B1

(12) United States Patent
West

(10) Patent No.: US 7,907,098 B1
(45) Date of Patent: Mar. 15, 2011

(54) LOG PERIODIC ANTENNA

(75) Inventor: James B. West, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 774 days.

(21) Appl. No.: 11/906,486

(22) Filed: Oct. 2, 2007

(51) Int. Cl.
*H01Q 11/10* (2006.01)
*H01Q 1/38* (2006.01)
*H01Q 9/00* (2006.01)

(52) U.S. Cl. ..... 343/792.5; 343/745; 343/700 MS

(58) Field of Classification Search ..... 343/792.5, 343/700 MS, 705, 745, 749–752, 876, 893
See application file for complete search history.

(56) References Cited

U.S. PATENT DOCUMENTS 3,389,396 A * 6/1968 Minerva et al. ..... 343/792.5
4,973,972 A * 11/1990 Huang ..... 343/700 MS
5,111,211 A * 5/1992 Dahlberg ..... 343/700 MS
5,648,786 A * 7/1997 Chung et al. ..... 343/770

* cited by examiner

*Primary Examiner* — Jacob Y Choi
*Assistant Examiner* — Robert Karacsony
(74) *Attorney, Agent, or Firm* — Matthew J. Evans; Daniel M. Barbieri

(57) ABSTRACT

A log periodic antenna comprises a plurality of radiating elements in an end fire configuration, each radiating element in the plurality of radiating elements comprises a conductor, and at least two shunt inductances connected to the conductor; a substrate connecting the plurality of radiating elements; and a log periodic stripline feed pathway superimposed on the substrate. The height of each radiating element of the plurality of radiating elements is about one hundredth the size of the wavelength and the length is about 0.14 the size of the wavelength at the lowest operating frequency of the log periodic antenna. The plurality of radiating elements is configured to produce impedance and radiation characteristics that are regularly repetitive as a logarithmic function of an excitation of frequency without performance degradation.

24 Claims, 4 Drawing Sheets

LOG PERIODIC ANTENNA

TECHNICAL FIELD

The present invention generally relates to the field of antennas, and more particularly to log periodic antennas for software defined radio applications, such as avionic software defined radio applications.

BACKGROUND

Antennas are utilized for communication, navigation, and surveillance. Aircrafts rely on communication navigation, and surveillance. Special considerations are considered when utilizing an antenna on an aircraft and/or other moving vehicles and devices.

Log periodic antennas (also known as log periodic arrays) are multi-element broad band, unidirectional, narrow-beam, antennas with impedance and radiation characteristics that are regularly repetitive as a logarithmic function of the excitation frequency. Arrays of multielement Log periodic antennas have similar performance but with increased directivity in one plane due to the arraying of individual log periodic antenna with a prescribed phase relationship. The elements may be dipoles within the log periodic array. Log periodic dipole arrays are driven in free space and cannot be close to a local ground and are therefore, non-conformal and/or cannot be mounted flush with a metallic structure.

Dipole log periodic antennas are difficult to drive against the ground. A log periodic scaled monopole array may be in an end fire configuration, but the log periodic scaled monopole array is non-conformal due to the height of the individual monopole elements that comprise the array. The height of this array is one quarter of the wavelength being transmitted and/or received (to the first order) at the lowest operating frequency of the array. Log periodic antenna-based phased arrays may be in an end fire configuration, but the log periodic phased arrays are, also, non-conformal. Microstrip broadside log periodic antennas and other types of planar log periodic arrays have broadside rather than end fire performance.

SUMMARY

The disclosure is directed to a log periodic antenna.

The log periodic antenna comprises a plurality of radiating elements in an end fire configuration, each radiating element in the plurality of radiating elements comprises a conductor, and at least two shunt inductances connected to the conductor; a substrate connecting the plurality of radiating elements; and a log periodic stripline feed pathway superimposed on the substrate. The height of each radiating element of the plurality of radiating elements is about one hundredth the size of the wavelength and the length is about 0.14 the size of the wavelength at the lowest operating frequency of the log periodic antenna. The plurality of radiating elements is configured to produce impedance and radiation characteristics that are regularly repetitive as a logarithmic function of an excitation of frequency without performance degradation.

The log periodic antenna comprises a plurality of radiating elements in an end fire configuration, each radiating element in the plurality of radiating elements comprises a conductor, at least two shunt inductance tuning elements, and a plurality of switches that control the at least two shunt inductance tuning elements and the conductor; a substrate connecting the plurality of radiating elements; and a log periodic stripline feed pathway superimposed on the substrate. The plurality of switches are capable of activating the at least two shunt inductance tuning elements to optimize a log periodic growth. The height of each radiating element of the plurality of radiating elements is about one hundredth the size of the wavelength and the length is about 0.14 the size of the wavelength at the lowest operating frequency of the log periodic antenna. The plurality of radiating elements is configured to produce impedance and radiation characteristics that are regularly repetitive as a logarithmic function of an excitation of frequency without performance degradation.

The log periodic antenna comprises a plurality of radiating elements in an end fire configuration, each radiating element in the plurality of radiating elements comprises a conductor, at least two tuning elements, the tuning element comprising at least one of microelectromechanical variable capacitors, ferroelectric variable capacitors, and switched length transmission line stubs, and a plurality of switches that control the at least two tuning elements and the conductor; a substrate connecting the plurality of radiating elements; and a log periodic stripline feed pathway superimposed on the substrate. The plurality of switches are capable of activating the at least two tuning elements to optimize a log periodic growth. The height of each radiating element of the plurality of radiating elements is about one hundredth the size of the wavelength and the length is about 0.14 the size of the wavelength at the lowest operating frequency of the log periodic antenna. The plurality of radiating elements is configured to produce impedance and radiation characteristics that are regularly repetitive as a logarithmic function of an excitation of frequency without performance degradation.

It is to be understood that both the foregoing general description and the following detailed description are exemplary and explanatory only and are not necessarily restrictive of the claims. The accompanying drawings, which are incorporated in and constitute a part of the specification, illustrate examples and together with the general description, serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Figure 1:
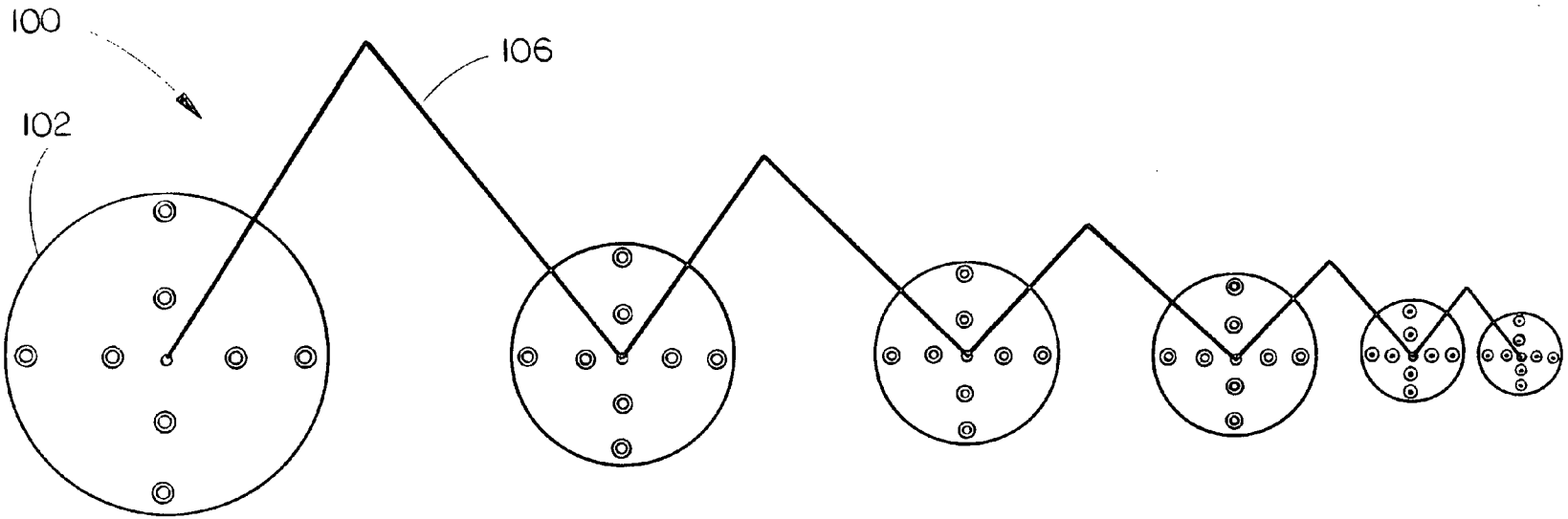
FIG. 1 is a partial top view illustrating a log periodic antenna and a representation of a log periodic stripline feed pathway.
Figure 2:
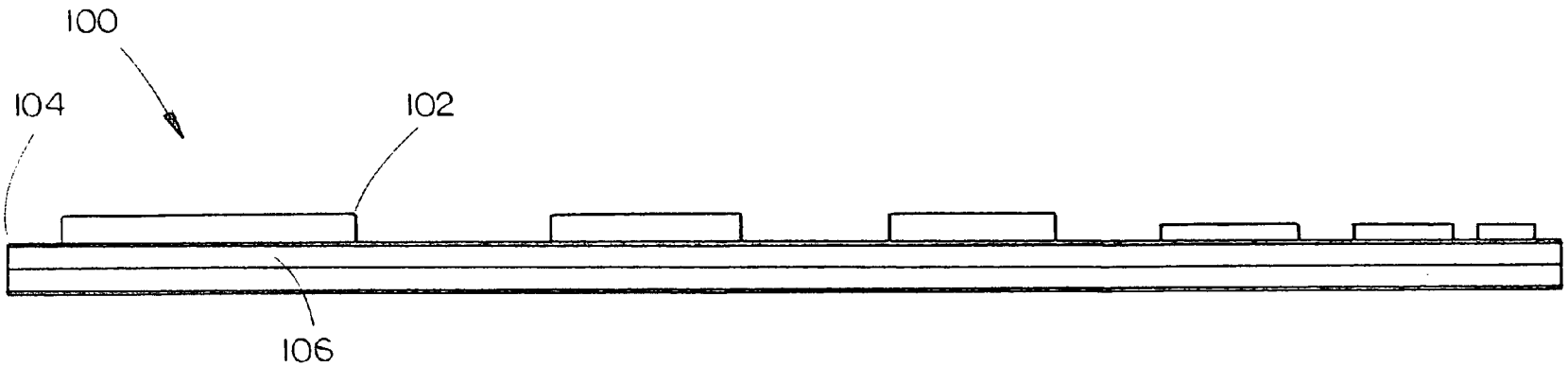
FIG. 2 is a cross-sectional side view illustrating a log periodic antenna.

Referring to FIGS. 1 and 2, a log periodic antenna 100 is shown. The log periodic antenna 100 may be capable of transmitting or receiving radio waves. The log periodic antenna 100 may be small in size and operates over a broad bandwidth. The log periodic antenna 100 may be scaled to operate over the very high frequency band (VHF) (with a frequency of 30 MHz to 300 MHz (with a wavelength of 10 m to 1 m)), the ultra high frequency band (UHF) (with a frequency of 300 MHz to 3,000 MHz (with a wavelength of 1 m to 100 mm)), the super high frequency band (SHF) (with a frequency of 3 GHz to 30 GHz (with a wavelength of 100 mm to 10 mm)), and/or the extremely high frequency band (EHF) (with a frequency of 30 GHz to 300 GHz (with a wavelength of 10 mm to 1 mm)). The log periodic antenna 100 may have extremely broad bandwidth due to the log periodic construct of the array and the high degrees of freedom in setting the resonant frequency and input impedance of the resonant frequency of the individual tuning elements, such as a shunt inductance tuning element. Further, the log periodic characteristic of the log periodic antenna may be optimized by dynamically changing the center frequency (or the resonant frequency at a centered coaxial input).

The log periodic antenna 100 may be employed with software defined radio system and/or may be an electronically scanned antenna that scans in azimuth. The azimuth scanning can be accomplishing by changing the relative time delay between different log periodic antennas 100 that comprise the phased array. The log periodic antenna 100 may be an end fire broadband log periodic array for a software defined radio system. The log periodic antenna 100 may be an end fire broadband log periodic azimuth scanned electrical scanned antenna for software defined radio applications. The log periodic antenna 100 may be utilized in a vehicle, in munitions, in an aircraft, or in any suitable object that utilizes an antenna. The log periodic antenna 100 may be utilized in commercial avionics applications.

The log periodic antenna 100 may be conformal or have the ability to conform to the surface of the object the log periodic antenna 100 is attached to, even if the surface is non-planar. The log periodic antenna 100 may be aerodynamic and/or have a low drag. The height (which may be measured from the mounted surface of the log periodic antenna) of the log periodic antenna is 0.01 wavelength and the width (which may be the diameter of the log periodic antenna) is 0.14 wavelength of the lowest operating frequency transmitted and/or received by the log periodic antenna 100. For example, at 30 MHz the width is 140 cm and the height is 10 cm, and at 30 GHz the width is 1.4 mm by 0.1 mm cm. The length of the tunable antenna 100 varies depending upon the desired operating bandwidth.

The log periodic antenna 100 may comprise an array of a plurality of radiating elements 102 and a substrate 104 with a superimposed (or printed) log periodic stripline feed pathway 106. The array 104 of plurality of radiating elements 102 is configured to produce impedance and radiation characteristics that are regularly repetitive as a logarithmic function of the excitation of frequency.

The substrate 104 may be any suitable insulating material with sufficient radio frequency properties that may have a pathway superimposed or printed on the substrate, such as conventional RF circuit boards (e.g., Teflon-Glass). This list is not restrictive. It is understood that any suitable substrate that may have a pathway superimposed (or printed) on the substrate and utilized with a periodic log antenna may be utilized without departing from the scope and intent of the disclosure. The compatible radio frequency planar transmission lines may comprise Microstrip, stripline, air stripline, and/or coplanar waveguide. This list is not restrictive. The log periodic stripline feed 106 may be the pathway superimposed or printed on the substrate 104.

The log periodic antenna 100 may comprise a plurality of radiating elements 102 configured to form an array. As used herein "a plurality of radiating elements" refers to the number of radiating elements necessary to form an array for a log periodic antenna 100. The log periodic antenna (array) 100 may be realized as a passive structure where the diameters, number, and positions of the shunt inductive posts realize the log periodic electrical growth parameters, along with the logarithmic growth of the element-to-element spacing within the log periodic antenna (array) 100, according to conventional theory. The log periodic antenna 100 in a broadband, end fire configuration may therefore, be produced with extremely low cost.

The plurality of radiating elements 102 in the array may be configured to be tunable. The plurality of radiating elements 102 in the array may be actively tuned to optimize the log periodic growth of the log periodic antenna 100. The tunable radiating element 102 is the same as the tunable radiating element disclosed in U.S. Patent Application with the express mail number EM005738889US filed on Sep. 27, 2007 herein incorporated by reference in its entirety.

The plurality of radiating elements 102 in the array are configured to move radiation in one direction and create a log periodic antenna 100. Therefore, the plurality of radiating elements 102 in the array are configured so that the length between the plurality of radiating elements 102 and the size of the plurality of radiating elements 102 increase logarithmically from one end of the log periodic antenna 100 to the other end of the log periodic antenna as illustrated in FIGS. 1 and 2.

The array may be in an end fire configuration. The end fire configuration allows for a directive gain over a wide bandwidth. Various end fire array configurations may be utilized in the log periodic antenna, such as a linear end fire array configuration, a two-dimensional end fire array configuration, and switched sector linear end fire array configuration. This list is not restrictive. It is contemplated that other suitable end fire configurations for log periodic antennas utilizing software defined radio applications may be utilized without departing from the scope and intent of the disclosure.

Figure 3:
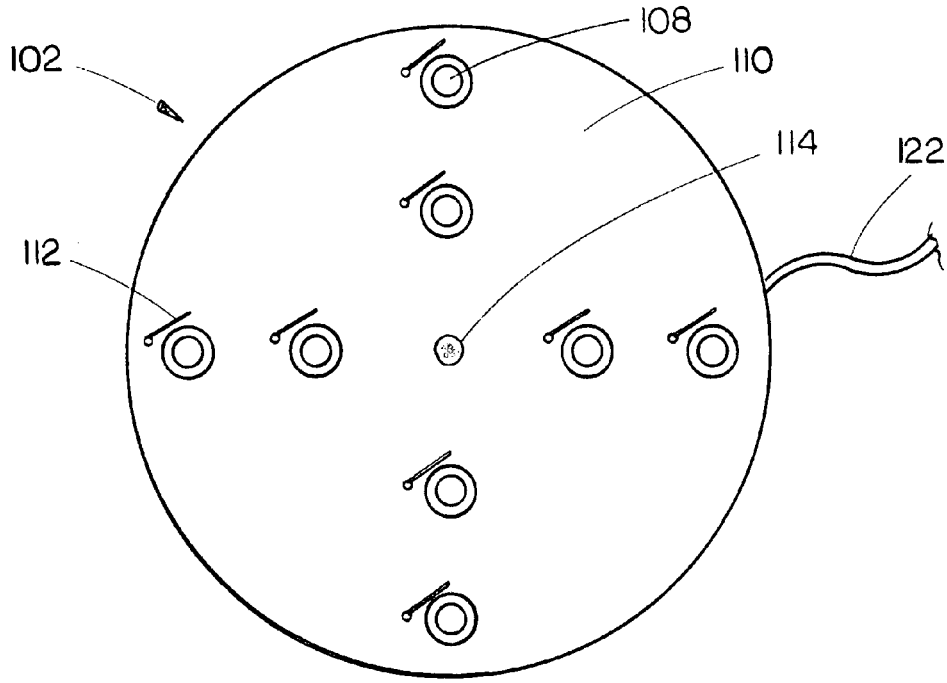
FIG. 3 is a top view illustrating a radiating element.
Figure 4:
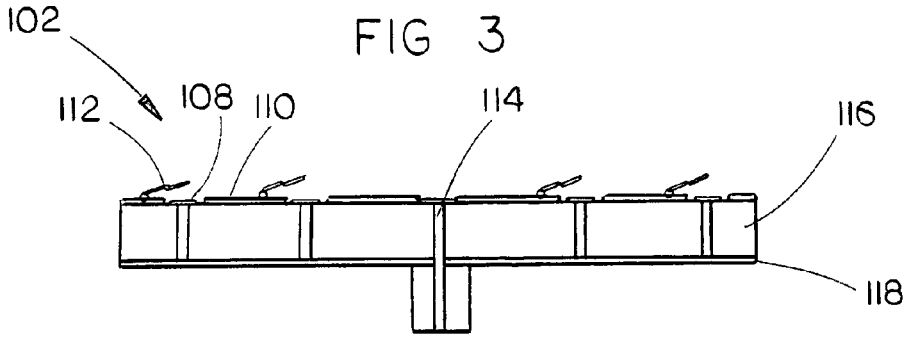
FIG. 4 is a cross-sectional side view illustrating a radiating element.

Referring now to FIGS. 3 and 4 a radiating element is shown. The plurality of radiating elements 102 may be in any suitable shape or size. The plurality of radiating elements 102 may be in a circular shape. The plurality of radiating elements 102 may be conformal or have the ability to conform to the surface of the object from with the plurality of radiating elements 102 is attached. The plurality of radiating elements 102 may be aerodynamic and/or have a low drag. The radiating element 102 may be about one hundredth the wavelengths in height, and 0.14 wavelengths in width of the lowest frequency wavelength being transmitted and/or received by the log periodic antenna in the log periodic antenna's lowest operating frequency.

The plurality of radiating elements 102 may comprise a conductor 110 and at least two shunt inductances 108. The plurality of radiating elements may further comprise a dielectric material 116, a plurality of switches 112, a centered coaxial input 114, a radio frequency cable 122, a contact 120, a direct circuit ground 124, a power source, a local ground 118, and/or a platform ground 138.

The centered coaxial input 114 extends through the center of the dielectric material 116 with one side of the dielectric material 116 covered, coated, and/or joined to the conductor 110 as illustrated in FIG. 4. The centered coaxial input 114 may transmit radio waves though a radio frequency cable 122. The centered coaxial input 114 may transmit radio waves to and/or from a radio.

The dielectric material 116 may be any suitable non-conductive material for an antenna, such as ceramic, glass, and/or plastics. The conductor 110 may be any suitable conductive material for an antenna, such as copper, silver, gold, and/or any other suitable conductor with high radio frequency conductivity. The conductor 110 may be a circular metal plate.

The at least two shunt inductances 108 may extend through the dielectric material 116 to the plane of the conductor 110. The at least two shunt inductances 108 may be fixed or tunable. The fixed at least two shunt inductances 108 are connected to the conductor 110. However, the tunable at least two shunt inductances 108 do not touch the conductor 110 as illustrated in FIGS. 3 and 4. The at least two shunt inductances 108 may be similar in manner to tuning elements of small monopole type antennas.

The at least two shunt inductances 108 may be integrated in the dielectric material 116 of radiating element 102. The radiating element 102 comprising the at least two shunt inductances 108 may form a monopole like radiation pattern. The log period antenna's 100 radiation pattern is monopole like in a plane perpendicular to the radiating elements by virtue of the monopole-like radiating patterns due to each of the plurality of radiating elements 102. The radiating element 102 comprising the at least two shunt inductances 108 may produce a monopole type end fire radiation pattern. The dielectric material 116 may support two shunt inductances 108 for each radiating element of the log period antenna 100. The dielectric material 116 may support four shunt inductances 108 for each radiating element of the log periodic antenna 100. The dielectric material 116 may support six shunt inductances 108 for each radiating element of the log period antenna 100. The dielectric material 116 may support eight shunt inductances 108 for each radiating element of the log period antenna 100. This list is not restrictive. It is contemplated that any suitable number of two or more shunt inductances 108 may be utilized without departing from the scope and intent of the disclosure.

The at least two shunt inductance tuning elements 108 may be in any suitable axially symmetric pattern within the dielectric material 118 for increasing the bandwidth and optimizing the log periodic growth of the log periodic antenna 100. The at least two shunt inductance tuning elements 108 may be positioned in a line radially outward from the centered coaxial input 102. The at least two shunt inductance tuning elements 108 may be positioned in two different perpendicular lines that extend radially outward from the centered coaxial input 114 as illustrated in FIGS. 1 and 3. The log periodic antenna 100 is readily adaptable because the plurality of radiating elements 102 has several degrees of freedom.

It is appreciated that the size and shape of the portion of the at least two shunt inductances 108 that is on same plane as the conductor 110 or the heads of the at least two shunt inductance tuning elements 108 may be configured for changing the bandwidth and/or for optimizing the log periodic growth of the log periodic antenna 100. The heads of the at least two shunt inductances 108 may be in a circular shape. The heads of each of the at least two shunt inductances 108 may be the same size and/or shape or may vary in size as along as the at least two shunt inductances 108 form an axially symmetric pattern. The size of the at least two shunt inductance elements 108 for the radiating element 102 may increase logarithmically from the centered coaxial input 114 in addition to the logarithmic sizing of the radiating elements 102 on the substrate.

It is appreciated that the number of, the size of, and the positioning of the at least two shunt inductances 108 may be adjusted to affect the resonant frequency and input impedance of each radiating element, which may optimize the log periodic antenna's 100 electrical growth parameter, commonly known as Tau ($\tau$), to optimize log periodic performance for desired applications. Repositioning the at least two shunt inductances 108 and increasing the amount of at least two shunt inductances 108 may also be utilized. Additionally, it is contemplated that the number of at least two shunt inductances 108 and the positioning of the at least two shunt inductances 108 may be adjusted to affect the radiation pattern in an azimuth plane. Therefore, the log periodic antenna's radiated phase in the azimuth plane may be adjusted for desired applications by repositioning the at least two shunt inductances 108 and increasing the amount of at least two shunt inductances 108 within each radiating element 102. The log periodic antenna 100 may have high gain azimuthally symmetric patterns.

Figure 5:
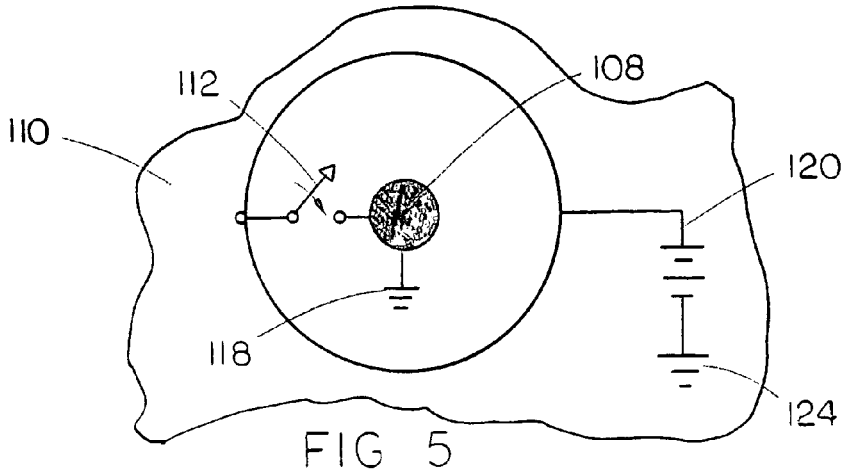
FIG. 5 is a circuit diagram of a switch in the radiating element comprising at least two tunable shunt inductances as illustrated in FIG. 4.

The plurality of radiating elements 102 comprising the tunable at least two shunt inductances may comprise a plurality of switches 112. As used herein the term "the plurality of switches 112" refers to a number of switches 112 that is equal to the number of tunable shunt inductances 108 present in the plurality of radiating elements 102. The plurality of switches 112 may be positioned to connect the conductor 110 and the tunable at least two shunt inductances 108 when closed as illustrated in FIGS. 3 through 5. Closing a switch 112 (e.g., establishing a connection within the radiating element 102) activates the tunable shunt inductance 108 and changes the bandwidth of the log periodic antenna 100. Referring to FIG. 5 a circuit diagram of the switch 112 as illustrated in FIG. 4 is shown.

The plurality of switches 112 may be opened and closed by a power source connected to the plurality of radiating elements 102. The plurality of the switches 112 may have a common voltage. A contact 120 may open or close the switch 112. The switch 112 may comprise a micoelectromechanical system (MEMS) switch, a pin diode, and/or a transistor. This list is not restrictive. It is contemplated that any suitable radio frequency switch for a log periodic antenna 100 may be utilized without departing from the scope and intent of the disclosure. Moreover, the plurality of switches 102 may utilize flip chip mounting concepts.

The opening and closing of the switches 112 may be selectively chosen in real time for optimizing the log periodic electrical growth (the parameter). The selection may calculated and/or chosen by software in the software define radio and/or in the scanning of the electric scan antenna. Other tuning elements, instead of or in conjunction with the at least two shunt inductances may be utilized in the radiating element, such as microelectromechanical system variable capacitors, ferroelectric variable capacitors, and switched length transmission line stubs for optimizing the log periodic growth of the log periodic antenna 100. This list is not restrictive. It is appreciated that any suitable mechanism and/or device for selecting and/or opening and closing the plurality of switches 112 of the log periodic antenna 100 for optimizing log periodic electrical growth of the log periodic antenna 100 may be utilized without departing from the scope and intent of the disclosure.

As already described a side of the dielectric material 116 is covered, coated, and/or joined to the conductor 110. A second side of the dielectric material 116 parallel and opposite the conductor 110 may be covered, coated, and/or joined to a local ground 118 as illustrated in FIGS. 4 and 5. The local ground 118 may be connected to the direct circuit 124. The local ground 118 and may be connected to or may be the same structure as a platform ground 138.

The log periodic antenna 100 may further comprise a platform ground 138, as illustrated in FIG. 6 if a local ground is present without any performance degradation. The platform ground 138 may be any metallic surface that is larger than the plurality of radiating elements. The log periodic antenna 100 may not require a platform ground 138 because the log periodic antenna 100 is insensitive to platform metallization. The platform ground 138 may be the outer surface of a vehicle, munitions, an aircraft, or any other suitable metal object that may utilize an antenna.

The size and/or diameter of the log periodic antenna 100 may be functionally related to the diameter of the optimal wavelength the log periodic antenna 100 may be configured to receive and/or transmit. Each radiating element within the log periodic array 100 has a nominal active operating frequency within the operating bandwidth of the log periodic antenna, and when active has a minimum diameter of approximately 0.14 wavelength of the optimal wavelength being transmitted and/or received by the log periodic antenna 100.

The log periodic antenna 100 may be mounted differently for vertical and horizontal polarizations as illustrated in FIG. 6.

Figure 6A:
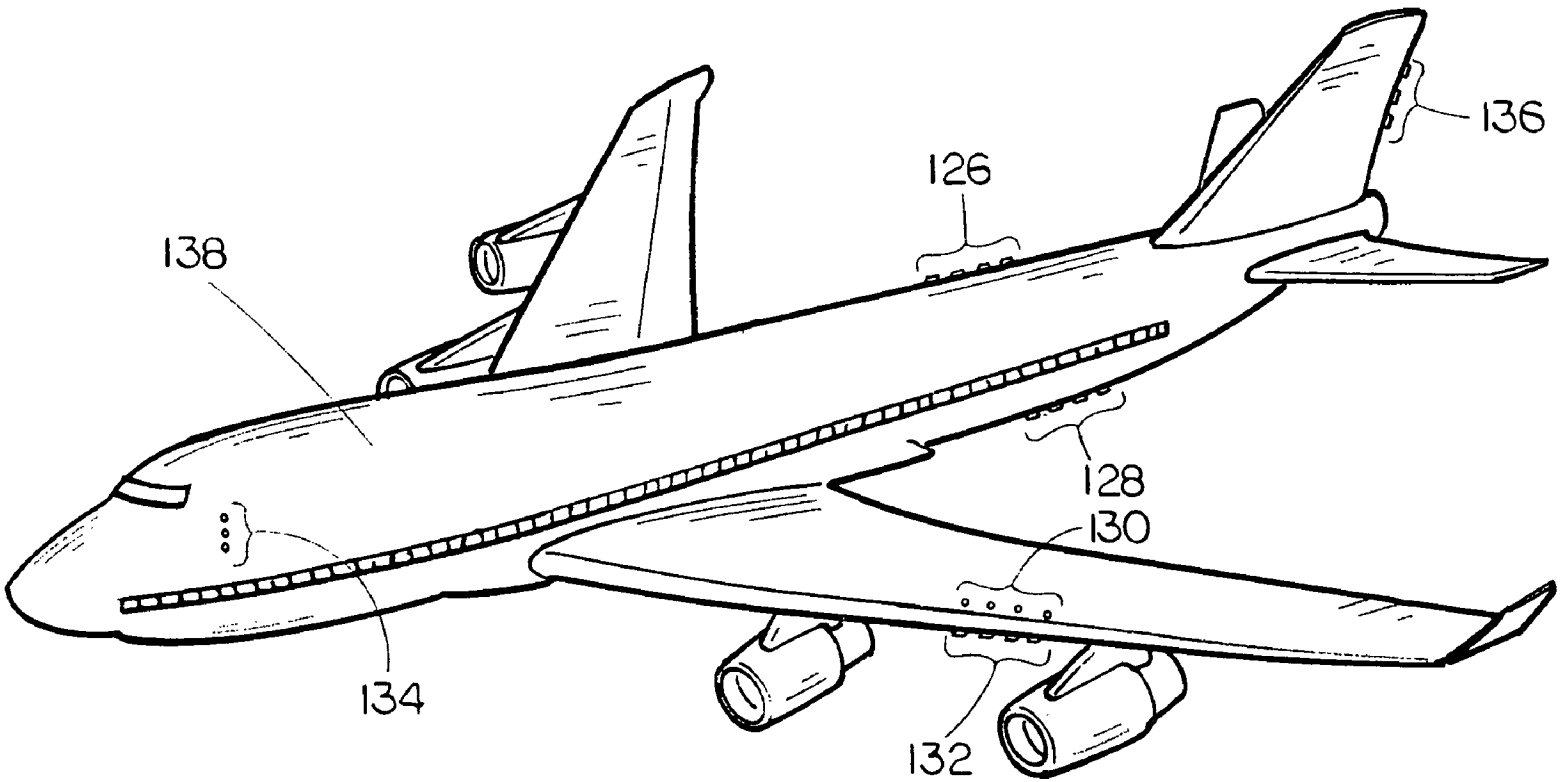
FIG. 6A is an isometric view illustrating log periodic antennas mounted to an aircraft with vertical or horizontal polarizations.
Figure 6B:
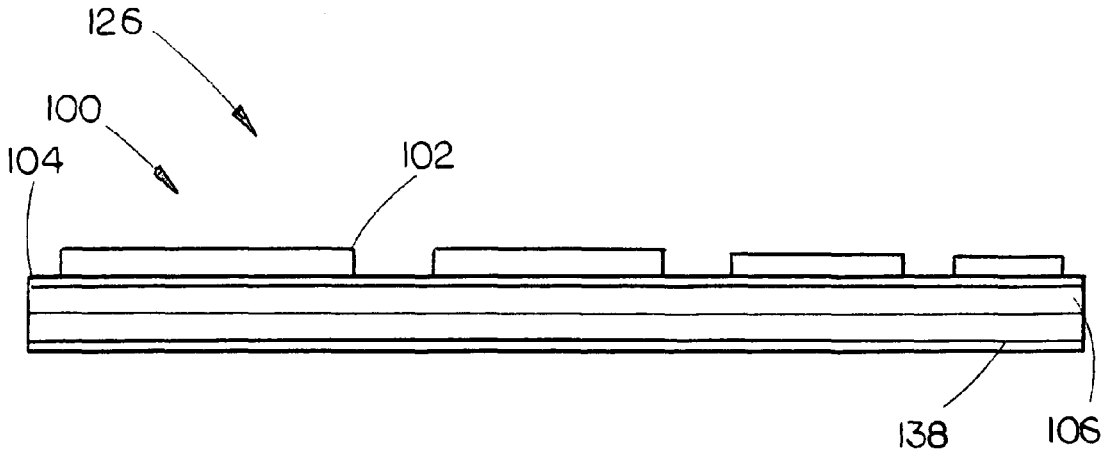
FIG. 6B is a cross-sectional side view of the log periodic antennas mounted to the aircraft with the vertical polarization as illustrated in FIG. 6A.

The periodic antenna 100 may be mounted to the top or bottom of the fuselage 126 and 128 or to the top or bottom of the wing 130 and 132 of an aircraft for a vertical polarization, as illustrated in FIG. 6A. The vertically polarized log periodic antenna 100 may be in an end fire configuration and may contain four radiating elements 102 attached to the same platform ground 138, as illustrated in FIGS. 6A and 6B. It is appreciated that number of radiating elements 102 in the array may vary depending upon the desired utilization of the log periodic antenna 100.

Figure 6C:
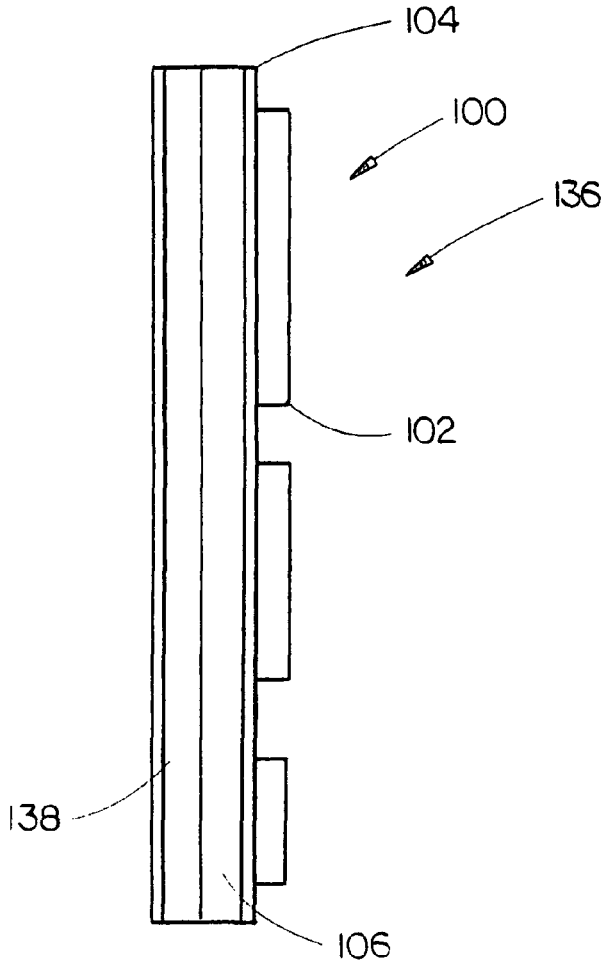
FIG. 6C is a cross-sectional side view of the log periodic antennas mounted to the aircraft with the horizontal polarization as illustrated in FIG. 6A.

The log periodic antenna 100 may be mounted to the side of the fuselage 136 and 134 of an aircraft for horizontal polarization, as illustrated in FIGS. 6A and 6C. The horizontally polarized log periodic antenna 100 may be in an end fire configuration and may contain three radiating elements 102 all connected to the same platform ground 138, as illustrated in FIGS. 6A and 6C. It is I appreciated that number of radiating elements 102 in the array may vary depending upon the desired utilization of the log periodic antenna 100. Circular phased arrays of log periodic antenna 100 can be realized in a rectilinear or radial array configuration to enable electric beam scanning in the azimuthal plane.

The log periodic antenna 100 may be applicable to highly integrated antenna technology. The log periodic antenna 100 may utilized a monopole-like vertical or horizontal polarization fuselage and wing mount directional end fire arrays, which are usable over a wide variety of frequency bands, e.g., VHF, and Ku band for numerous software defined radio applications and communication, navigation, and surveillance radio systems. The log periodic antenna 100 may utilized a monopole-like horizontal polarization fuselage "side mount" directional end fire array, Furthermore, the application of the log periodic antenna 100 may increase system functionality for phased array technology.

The log periodic antenna 100 may be produced at a cost lower than other broadband directional antennas for broadband systems. The cost effective log periodic antenna 100 may also be utilized in electronic warfare (EW), signals intelligence (SIGINT) (e.g., intelligence gathering by the interception of sensitive or encrypted information), military broadband reconfigurable systems, broadband connectivity airborne Ka band commercial satellite communication systems, and surveillance. The periodic antenna 100 is desirable for joint tactical radio systems, the broadband communications, Military International Software Defined Radio (ISDR), and similar radio systems.

It is believed that the present invention and many of its attendant advantages will be understood by the foregoing description, and it will be apparent that various changes may be made in the form, construction and arrangement of the components thereof without departing from the scope and spirit of the disclosure or without sacrificing all of its material advantages. The form herein before described being merely an explanatory embodiment thereof, it is the intention of the following claims to encompass and include such changes.

What is claimed is:

1. A log periodic antenna comprising:

a plurality of radiating elements in an end fire configuration, each radiating element in the plurality of radiating elements comprising, a conductor, and at least two shunt inductances connected to the conductor and connected to a ground;

a substrate connecting the plurality of radiating elements; and a log periodic stripline feed pathway superimposed on the substrate, wherein the height of each radiating element of the plurality of radiating elements is about one hundredth the size of the wavelength and the length is about 0.14 the size of the wavelength at the lowest operating frequency of the log periodic antenna, and wherein the plurality of radiating elements is configured to produce impedance and radiation characteristics that are regularly repetitive as a logarithmic function of an excitation of frequency without performance degradation.

2. The log periodic antenna as claimed in claim 1, wherein the log periodic antenna is at least one of electrically scanned or azimuth scanned.

3. The log periodic antenna as claimed in claim 1, wherein the log periodic antenna is capable of being configured to receive and transmit a radio frequency across radio frequency bands selected from the group of a VHF band, a UHF band, a SHF band, and EHF band.

4. The log periodic antenna as claimed in claim 1, wherein the log periodic antenna has vertical polarization.

5. The log periodic antenna as claimed in claim 1, wherein the log periodic antenna has a horizontal polarization.

6. The log periodic antenna as claimed in claim 1, wherein the plurality of radiating elements increase in size and distance apart logarithmically from one end of the log period antenna to the other end.

7. The log periodic antenna as claimed in claim 6, wherein the at least two shunt inductances are positioned in an axially symmetric pattern.

8. The log periodic antenna as claimed in claim 7, wherein the at least two shunt inductances are positioned in line that extends radially outward from a centered coaxial input.

9. The log periodic antenna as claimed in claim 7, wherein the at least two shunt inductances increase in size and distance apart logarithmically as the at least two shunt inductances extend from a centered coaxial input.

10. The log periodic antenna as claimed in claim 7, wherein the at least two shunt inductances are positioned in two perpendicular lines that extend radially outward from a centered coaxial input.

11. A log periodic antenna comprising:

a plurality of radiating elements in an end fire configuration, each radiating element in the plurality of radiating elements comprising, a conductor, at least two shunt inductance tuning elements, and a plurality of switches that control the at least two shunt inductance tuning elements and the conductor;

a substrate connecting the plurality of radiating elements; and a log periodic stripline feed pathway superimposed on the substrate, wherein the plurality of switches are capable of activating the at least two shunt inductance tuning elements to optimize a log periodic growth, wherein the height of each radiating element of the plurality of radiating elements is about one hundredth the size of the wavelength and the length is about 0.14 the size of the wavelength at the lowest operating frequency of the log periodic antenna, and wherein the plurality of radiating elements is configured to produce impedance and radiation characteristics that are regularly repetitive as a logarithmic function of an excitation of frequency without performance degradation.

12. The log periodic antenna as claimed in claim 11, wherein the log periodic antenna is utilized in a software defined radio system.

13. The log periodic antenna as claimed in claim 12, wherein the log periodic antenna is at least one of electrically scanned or azimuth scanned.

14. The log periodic antenna as claimed in claim 11, wherein the log periodic antenna utilizes at least one of microelectromechanical variable capacitors, ferroelectric variable capacitors, and switched length transmission line stubs to open and close the plurality of switches.

15. The log periodic antenna as claimed in claim 11, wherein the log periodic antenna has vertical polarization.

16. The log periodic antenna as claimed in claim 11, wherein the log periodic antenna has a horizontal polarization.

17. The log periodic antenna as claimed in claim 11, wherein the plurality of switches comprise at least one of a microelectromechanical system, a pin diode, and a transistor.

18. The log periodic antenna as claimed in claim 11, wherein the plurality of radiating elements increase in size and distance apart logarithmically from one end of the log period antenna to the other end.

19. The log periodic antenna as claimed in claim 18, wherein the at least two shunt inductance tuning elements are positioned in an axially symmetric pattern.

20. The log periodic antenna as claimed in claim 19, wherein the at least two shunt inductance tuning elements are positioned in line that extends radially outward from a centered coaxial input.

21. The log periodic antenna as claimed in claim 19, wherein the at least two shunt inductance tuning elements increase in size and distance apart logarithmically as the at least two shunt inductance tuning elements extend from a centered coaxial input.

22. The log periodic antenna as claimed in claim 19, wherein the at least two shunt inductance tuning elements are positioned in two perpendicular lines that extend radially outward from a centered coaxial input.

23. A log periodic antenna comprising:

a plurality of radiating elements in an end fire configuration, each radiating element in the plurality of radiating elements comprising, a conductor, at least two tuning elements, the tuning element comprising at least one of microelectromechanical variable capacitors, ferroelectric variable capacitors, and switched length transmission line stubs, and a plurality of switches that control the at least two tuning elements and the conductor;

a substrate connecting the plurality of radiating elements; and a log periodic stripline feed pathway superimposed on the substrate, wherein the plurality of switches are capable of activating the at least two tuning elements to optimize a log periodic growth, wherein the height of each radiating element of the plurality of radiating elements is about one hundredth the size of the wavelength and the length is about 0.14 the size of the wavelength at the lowest operating frequency of the log periodic antenna, and wherein the plurality of radiating elements is configured to produce impedance and radiation characteristics that are regularly repetitive as a logarithmic function of an excitation of frequency without performance degradation.

24. A log periodic antenna as claimed in claim 1, wherein at least one conductor of the plurality of radiating elements is substantially circular.

* * * * *